US007665412B2

(12) United States Patent
Walls

(10) Patent No.: US 7,665,412 B2
(45) Date of Patent: Feb. 23, 2010

(54) REVERSIBLE RALLY FLAG

(75) Inventor: Gregg K. Walls, Williamsville, NY (US)

(73) Assignee: Kricket Enterprises, Inc., Williamsville, NY (US)

( * ) Notice: Subject to any disclaimer, the term of this patent is extended or adjusted under 35 U.S.C. 154(b) by 34 days.

(21) Appl. No.: 11/974,151

(22) Filed: Oct. 11, 2007

(65) Prior Publication Data

US 2009/0095210 A1 Apr. 16, 2009

(51) Int. Cl.
*G09F 17/00* (2006.01)

(52) U.S. Cl. ..... 116/173; 40/586

(58) Field of Classification Search ..... 116/173, 116/174, 175; 40/586, 593, 603, 604, 618; D11/168, 171
See application file for complete search history.

(56) References Cited

U.S. PATENT DOCUMENTS 1,133,583 A * 3/1915 Simmons ..... 116/175
D118,201 S * 12/1939 Bonn ..... D2/603
3,640,242 A * 2/1972 Guinn et al. ..... 116/173
4,574,726 A * 3/1986 Sullivan ..... 116/28 R
4,688,502 A * 8/1987 Krieger ..... 112/439
5,400,437 A * 3/1995 Koutras ..... 2/84
5,507,109 A * 4/1996 Rinzler ..... 40/603
5,904,116 A * 5/1999 Wyner et al. ..... 116/173
6,866,002 B1 * 3/2005 Christy et al. ..... 116/173
6,976,786 B1 * 12/2005 Stanley, Jr. ..... 383/25
2003/0074820 A1 4/2003 Fink
2004/0128883 A1 * 7/2004 Greenberg ..... 40/586
2004/0251720 A1 12/2004 Micheletti

OTHER PUBLICATIONS http://en.wikipedia.org/wiki/Flag, Sep. 18, 2007.
http://en.wikipedia.org/wiki/Rally_cap, Dec. 3, 2007.

* cited by examiner

*Primary Examiner*—R. A. Smith
(74) *Attorney, Agent, or Firm*—Simpson & Simpson, PLLC

(57) ABSTRACT

A flag having a first panel having an outer surface and an inner surface, the first panel bearing a first indicia visible from the outer surface when the flag is turned outside-out, and from the inner surface when the flag is turned inside-out; and, a second panel having an outer surface and an inner surface, the second panel bearing a second indicia visible both from the outer surface when the flag is turned outside-out, and from the inner surface when the flag is turned inside-out; the first and second panels each having a perimeter, the perimeters of the first and second panels substantially secured to one another to form a pouch having a single opening to accommodate turning the flag inside-out.

2 Claims, 16 Drawing Sheets

REVERSIBLE RALLY FLAG

FIELD OF THE INVENTION

The invention relates generally to improvements in flags and banners, and more particularly to combining features and elements of rally caps with flags. In particular, the invention relates to a reversible flag which is operatively arranged to display a normal view of a logo in a first orientation of the flag, and to display an obverse view of the logo when the flag is reversed, i.e., turned inside-out.

BACKGROUND OF THE INVENTION

Since the present invention relates both to rally caps and flags and is, in fact, a combination of these two articles of manufacture, it is perhaps useful to understand these seemingly unrelated products to better appreciate their unique combination.

Rally Caps

According to Wikipedia: "A rally cap is a baseball cap worn while inside-out or in another unconventional manner by players or fans, in order to will a team into a come-from behind rally late in the game. The Rally Cap is primarily a baseball superstition. The first appearance of the Rally Cap was during the 1942 baseball season, when fans of the Detroit Tigers, while in attendance at Tiger Stadium, occasionally would wear their baseball caps inside-out as a makeshift talisman to generate a come-from-behind victory in the late innings of a baseball game. The superstition spread from the fans to the Tigers players themselves, and rose to national awareness during the 1945 World Series when the Detroit Tigers were playing the Chicago Cubs. The Tigers were tied in Game 5 with the series tied at 2-2. In the $6^{th}$ inning of that game, the radio announcer mentioned certain members of the Tigers in the dugout wearing their caps inside out. Subsequently, in that inning of that game, the Tigers scored 4 runs after a ball rolled between the legs of Chicago first baseman Phil Cavaretta. The Tigers then went on to win the game 8-4. The historic rally led to a Game 7 win, allegedly with the prominent assistance of their "Rally Caps" allowing them to become the 1945 World Series Champions. The Rally Cap subsequently was adopted by baseball fans internationally, being used to give their team a little extra mojo and come from behind. The Rally Cap was later seen in 1986 when the New York Mets wore them in their come from behind World Series victory over the Boston Red Sox. The belief behind the rally cap is generally to sacrifice a small amount of one's dignity in exchange for a little luck for one's team. It is widely understood that the baseball cap must be one depicting the logo of the team in order to be used as a Rally Cap."

Flags, Banners & Pennants

Flags, banners, and pennants are well-known and generally include a pole, staff or mast and a piece of woven cloth or other material bearing a design, logo or other indicia. Sometimes the term "flag" is used to denote the graphic design employed by a flag, although this is not the meaning of the term used in this patent. Flags and banners are closely related, and, for purposes of this patent, are synonymous. Most flags have a single ply of material, bearing a logo or indicia on each side of the single ply. http://en.wikipedia.org/wiki/Flag.

Flags are usually, but not always, rectangular in shape, but they may be of any size and shape. Triangular flags and banners represent one such alternative shape.

A flag may be secured to its mast in any number of ways. For example, the flag may include eyelets located along an edge of the flag, through which ropes or lines may pass to secure the flag to the mast. In the alternative, the flag may have a closed loop of material that extends along an edge of the flag proximate the mast. The closed loop is placed over the pole to support the flag. Some flags are designed and intended to be flown on poles. Other flags are designed and intended to be hand-held or clamped (for example to automobile windows).

Designs on flags can be made in a number of ways. They can be dyed, embroidered, silk-screened, printed, or woven directly into the fabric, for example. Some flags are dyed through and through so that the reverse side is the mirror image of the obverse (front) side. This arrangement is possible where the design is symmetrical in an axis parallel to the flag pole, where the obverse and reverse will be identical despite the mirror-image. This doesn't usually work where the flag design includes text.

Flags are used in messaging, advertising, decorative purposes, and, of course, to symbolize and identify countries and nations. They are also used to show loyalty and support for sports teams. In many "sports towns" it is not uncommon for ardent fans to display team loyalty flags in their front yards, mounted to their houses, held in hand at games, or even mounted to their car windows. These flags tend to become especially visible during playoffs in professional sports (NHL, NFL, MLB & NBA). For example, during the 2007 NHL playoffs, it was probably not possible to drive on any major road in Buffalo, N.Y. without passing a car displaying a Buffalo Sabres team flag mounted externally to a vehicle window or vehicle antenna. Most of these fans probably wanted to show their support for the team in a special way when the Sabres fell behind in the playoffs.

A related problem yet to be solved is to provide a means of satisfying needs of sports fans in cities having more than one professional sports franchise. For example, in Buffalo, fans of football, hockey and baseball have heretofore had to purchase one team flag for the Buffalo Sabres, another for the Buffalo Bills, and yet another for the Buffalo Bisons (or Toronto Blue Jays). These "multiple sports" fans have endured a long-felt need for a flag that can be reversed to support different teams during different seasons. Similarly, manufacturers of these flags presently have to stock individual team flags. If one flag could be easily turned inside-out to display another team logo, a vendor could bring a single product inventory to Ralph Wilson Stadium when the Bills take on the Miami Dolphins or New England Patriots. A Bills fan would display the flag normally ("outside-out" and/or "inside-in"); a Dolphins fan would display the flag inside-out. The concept of a dual-sport or dual-team flag could also be expanded to non-sports use. For example, an outer indicia/logo could be displayed for Halloween, and an inner indicia/logo could be displayed for Thanksgiving.

While rally caps have long been known and displayed at sporting events, there has been a longfelt need, at least by sports fans, for a rally flag that combines the elements and features of a flag and a rally cap, that can be used not only at a game itself, but also between games in a playoff series to rally a team that has fallen behind in the series.

BRIEF SUMMARY OF THE INVENTION

The present invention broadly comprises a flag comprising a first panel having an outer surface and an inner surface, the first panel bearing a first indicia; and, a second panel having an outer surface and an inner surface, the second panel bearing a second indicia; the first and second panels each having a perimeter, the perimeters of the first and second panels substantially secured to one another to form a pouch having a single opening to accommodate turning the flag inside-out.

A general object of the present invention is to provide a rally flag which is capable of displaying a first indicia when arranged "outside-out" and a second indicia when arranged "inside-out".

Another object of the present invention is to provide a flag which is arranged to display one sports team logo when arranged "outside-out" and a second sports team logo when arranged "inside-out".

A further object of the present invention is to provide a flag which is arranged to display one holiday related graphic design when arranged "outside-out" and a second, different holiday related graphic design when arranged "inside-out".

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1A:
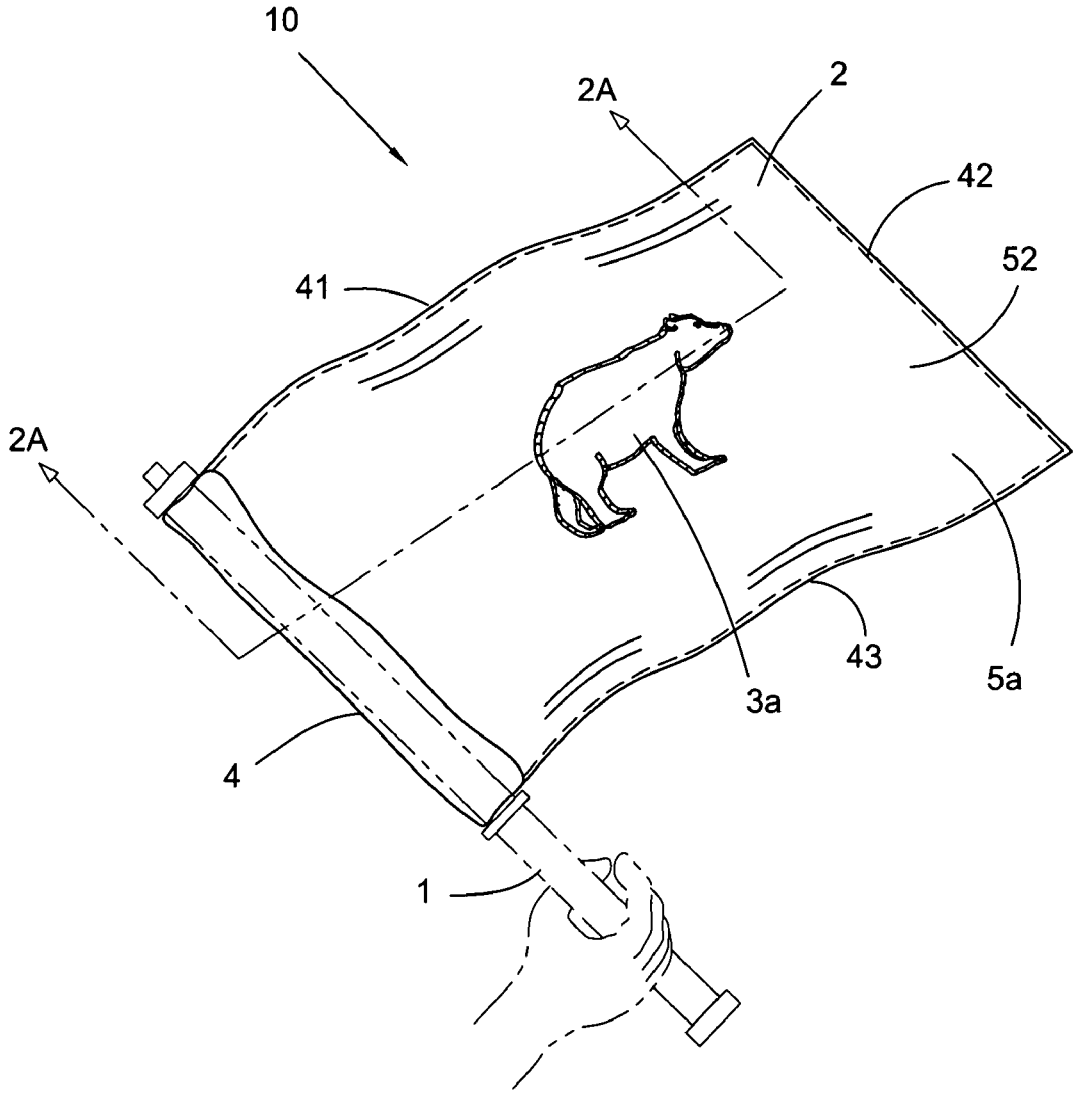
FIG. 1A is a perspective view of a preferred embodiment flag of the present invention displaying a first side.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described. In addition to the ordinary meaning of technical and scientific terms, the phrases "outside-out" and "inside-out" are used throughout the description of the present invention. The term "inside-out" is intended to have its ordinary meaning as it is typically applied to describe socks, underwear, jackets, coats, and other apparel. For example, apparel worn in its normal intended manner is described herein as "outside-out", where the outer surface faces away from the wearer. The term "inside-out" refers to the condition of the apparel when the garment is arranged such that the inner surface that normally faces the wearer is reversed to face away from the wearer. For example, most shirts include one or more hang-tags located on an inner surface facing the wearer, not usually visible to others. When such a shirt is worn "inside-out" these tags would be visible to others. Similarly, some jackets are purposely made of two different colors and/or patterns. They assume one appearance when worn in a first "outside-out" orientation, and a second "inside-out" appearance when worn in a second orientation. These terms have identical meaning when used to describe the flag of the invention. The flag has two orientations: "outside-out" and "inside-in", with resultant different visual effects accordingly.

In addition, the flag of the present invention includes one or more indicia affixed to both the outside of the flag for normal viewing, and to an inside surface of the flag for viewing when the flag is turned inside out. These indicia may be affixed to individual panels of the flag in any number of ways, such as embroidery, silk screening, printing, etc. In the case of embroidery, it should be recognized and appreciated that an indicia will have one appearance when viewed from outside the flag, and will have a second but related appearance when viewed when the flag is turned inside out. This second appearance is termed the verso of the first. The term "verso", according to the dictionary, means "The back of a coin or medal." In this patent, we define the term "verso" to mean the appearance of an embroidered logo or design, when the fabric upon which the logo or design is embroidered is turned inside-out. (Although the dictionary defines the term "verso" as a noun, we also use the term as an adjective in this patent.) As is well known in the art, an embroidered logo, for example, of a sports team, will have a first appearance when viewed normally (i.e., "outside-out"), and a second related appearance when the logo is viewed "inside-out". For example, if the famous New York Yankees logo is embroidered onto a T-shirt, and the shirt is turned inside out, almost everyone would recognize the reversed embroidered Yankee's logo as that of the New York Yankees. It should also be understood that the flag of the present invention can be of any size, and any shape. It may be designed to be supported and flown from a mast, or displayed in some other manner.

Figure 1B:
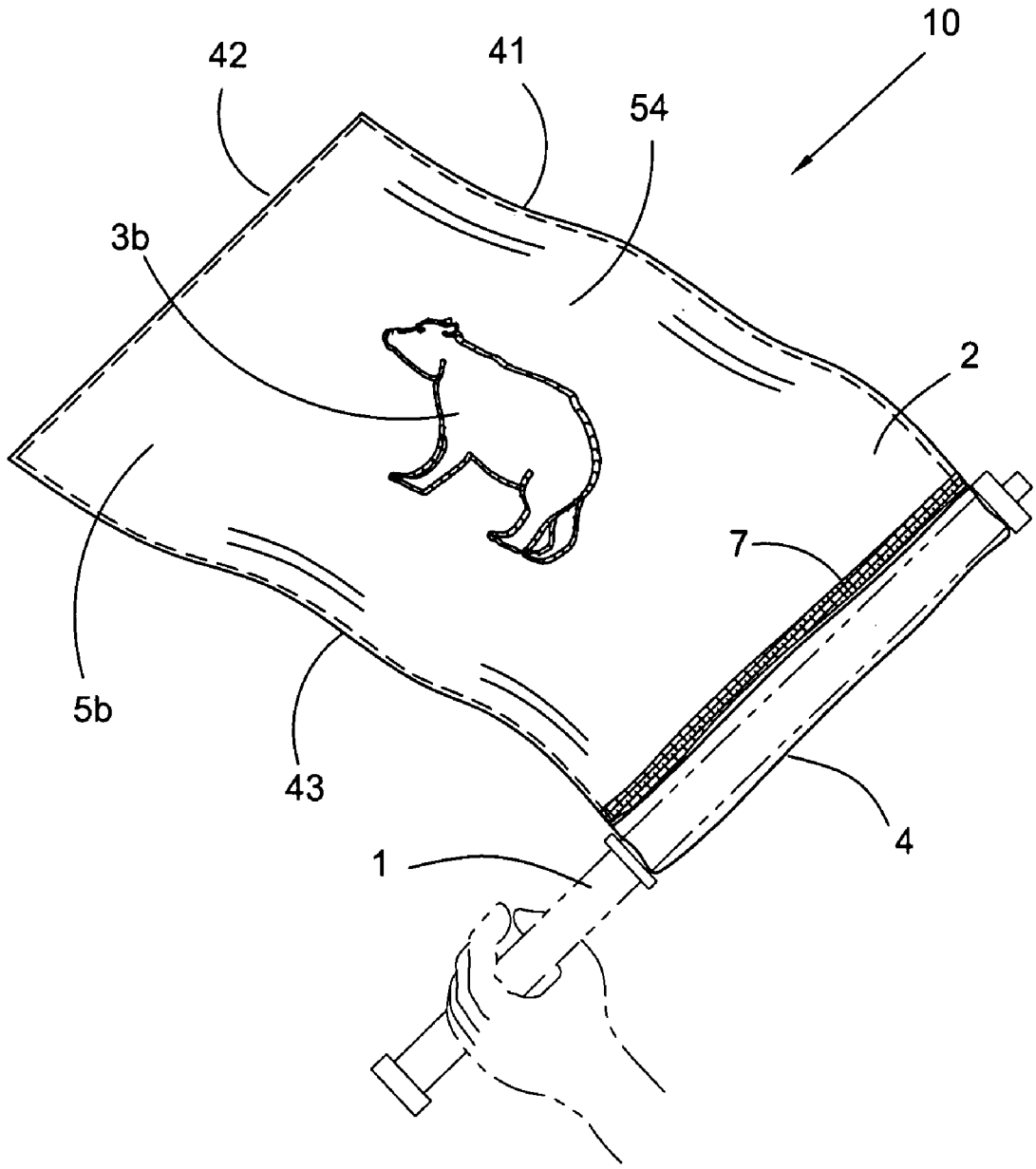
FIG. 1B is a perspective view of the flag shown in FIG. 1 but arranged to display a second side.

FIG. 1 is a perspective view of the preferred embodiment of rally flag assembly 10 of the present invention, shown in a first "outside-out" orientation. The flag assembly includes rod 1 (optional), flag 2, outer indicia 3*a*, and fastener 4. Flag 2 includes first panel 52 having outer surface 5*a*, and an opposing panel 54 having outer surface 5*b* shown in FIG. 2. In a preferred embodiment, outer indicia 3*a* which appears on outer surface 5*a* is identical to outer indicia 3*b* which appears on outer surface 5*b*, although it could be a different design. In a preferred embodiment, first panel 52 and second panel 54 are made of a traditional flag material which is generally resilient and can withstand being located outdoors for extended periods of time. The panels may be made of cloth, fabric, plastic nylon, polyester, cotton, rayon, or any other suitable material known in the art, or a combination of suitable materials. It should be appreciated at the outset that flag 2 is operatively arranged to bear and display at least a first indicia (e.g., outer indicia 3*a* or 3*b* or both) when the flag is turned outside-out as shown in FIG. 1, and operatively arranged to bear and display a second indicia 3*a*' and/or 3*b*' (also referred to as inner indicia) when the flag is turned inside-out. The second indicia may be identical to the first indicia, may be different from the first indicia, or may be related to the first indicia (i.e., the second indicia may look like the first indicia except turned inside-out, i.e., the obverse of the first indicia.) As an example of an inner indicia that is "related to" the outer indicia, a team logo may be embroidered on a fabric or cloth, and visible from both the inner and outer surfaces. The logo viewed from the outside will be crisp and clean, whereas when viewed from the inside the logo will be identifiable but may show threads and linings, etc., which would not be visible from the outside. In a preferred embodiment, first indicia 3*a*, 3*b* and second indicia 3*a*', 3*b*' are sports team insignias, logos, or symbols. In FIG. 1, the logo comprises a team logo for a fictitious sports team, the Buffalo Bears, and the logo depicted is a bear.

In a preferred embodiment, and with reference to FIGS. 1 and 2, flag 2 comprises first panel 52 and second panel 54, which are stitched together along three sides 41, 42 and 43, respectively (sides 41, 42 and 43 are common to panels 52 and 54, and referred to the stitched intersection of the two panels). Although both panels 52 and 54 are both rectangular in shape in a preferred embodiment, the fourth sides, proximate the mast, and opposite side 42, is left open (unstitched) so as to form a pouch between the two panels. This pouch and its function will be described in more detail infra. Thus it is seen that each panel has a perimeter, and that the two panels are joined to one another substantially, but not completely, about the perimeters. For the rectangular shaped flag shown, where each panel is defined by a perimeter with four sides, three of the sides of one panel are joined to three corresponding sides of the second panel. The fourth sides of each panel are not sealed to one another, thereby creating a pouch between the two panels. A person can reach inside the pouch to turn the flag inside-out. First panel 52 may be fixedly secured to second panel 54 by stitches, adhesive, or any other means known in the art.

Figure 2A:
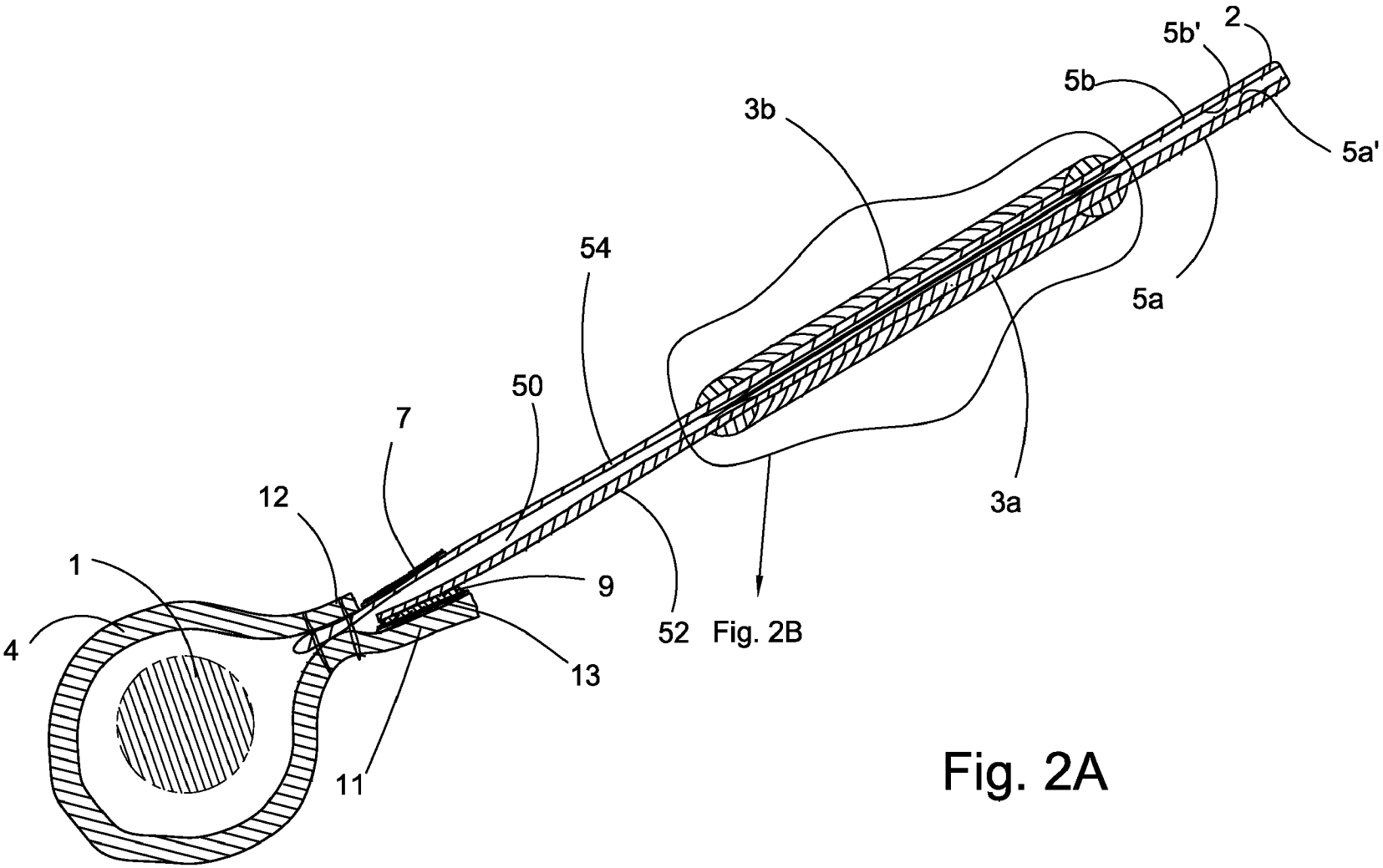
FIG. 2A is a cross-sectional view of the flag shown in FIG. 1, taken generally along line 2-2 in FIGS. 1A and 1B, showing the flag in an "outside-out" orientation.
Figure 2B:
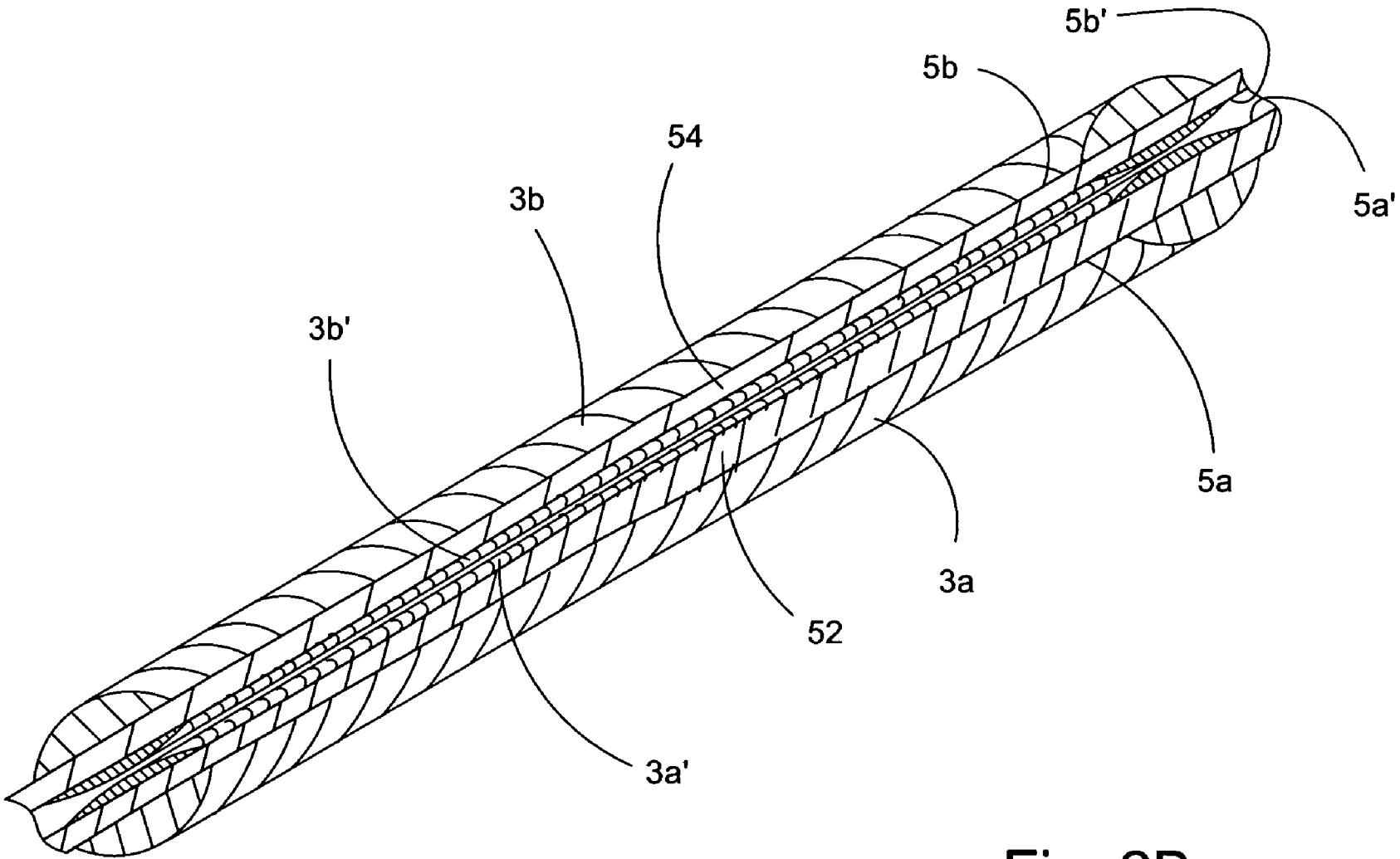
FIG. 2B is an enlarged view of the section of FIG. 2A labeled "FIG. 2B"

As best seen in FIG. 2B, which is an enlargement of the encircled area labeled FIG. 2B, first panel 52 has two sides, 5*a* and 5*a*', which are substantially opposite from each other. By substantially opposite, we mean that side 5*a* is on one face of first panel 52 and side 5*a*' is located on a second face which is 180 degrees from the first face. In other words, sides 5*a* and 5*a*' are arranged back-to-back. Similarly, second panel 54 has two sides, 5*b* and 5*b*', which are substantially opposite from each other. By substantially opposite, we mean that side 5*b* is on one face of second panel 54 and side 5*b*' is located on a second face which is 180 degrees from the first face. In other words, sides 5*b* and 5*b*' are arranged back-to-back.

The flag of the present invention is arranged to be held, mounted and displayed in any number of ways well known to those having ordinary skill in the art. The flag may be mounted to a flag pole or mast. It may be mounted to a pole cantilevered to a building. It could be mounted to a handheld pole, or to a mast having a clamp arranged for mounting to a vehicle window. It may be mounted to a vehicle radio antenna. In a preferred embodiment the flag includes outer fastener 4 which is especially adapted to detachably secure a flag to a mast clamp externally to a moving vehicle. This use of the rally flag presents a unique challenge in that the flag can be subjected to strong wind when the vehicle is moving, and the fastener needs to keep the pouch closed during travel, and accommodate reversibility.

Figure 2C:
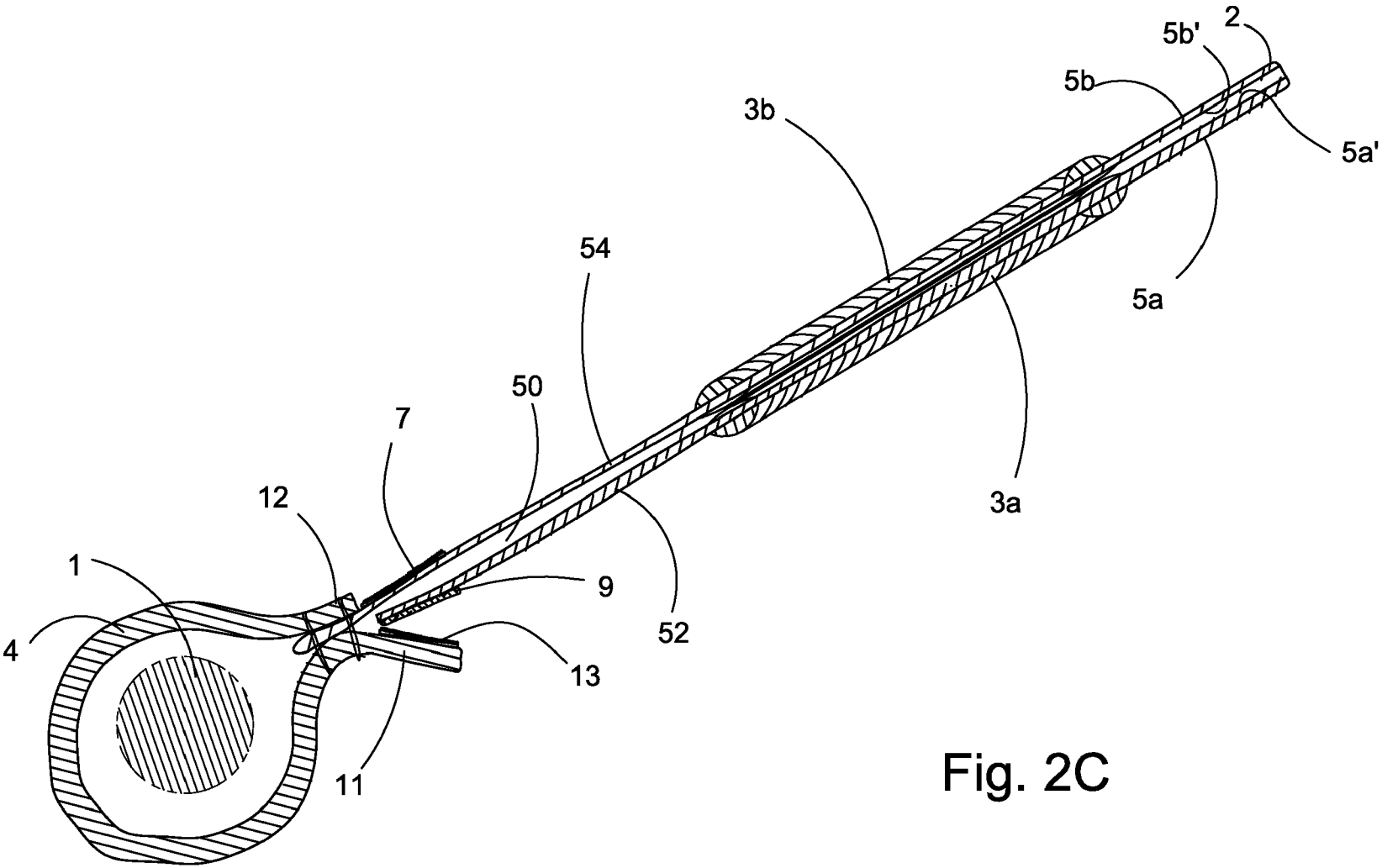
FIG. 2C is a view of the invention similar to FIG. 2A, showing the flag just prior to being turned "inside-out"
Figure 2D:
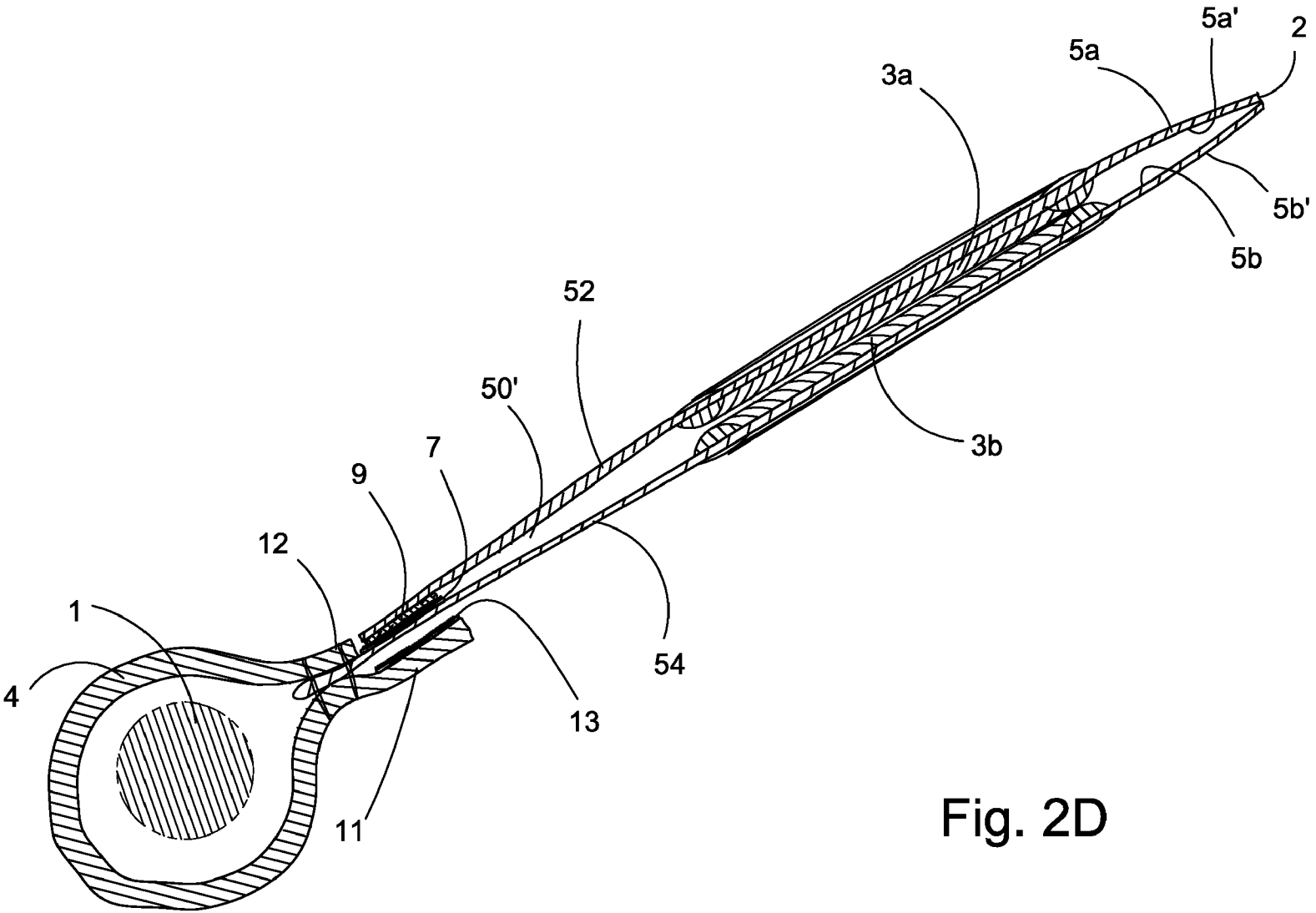
FIG. 2D is a view of the invention similar to FIGS. 2A and 2C, except showing the flag in an "inside-out" orientation.
Figure 2E:
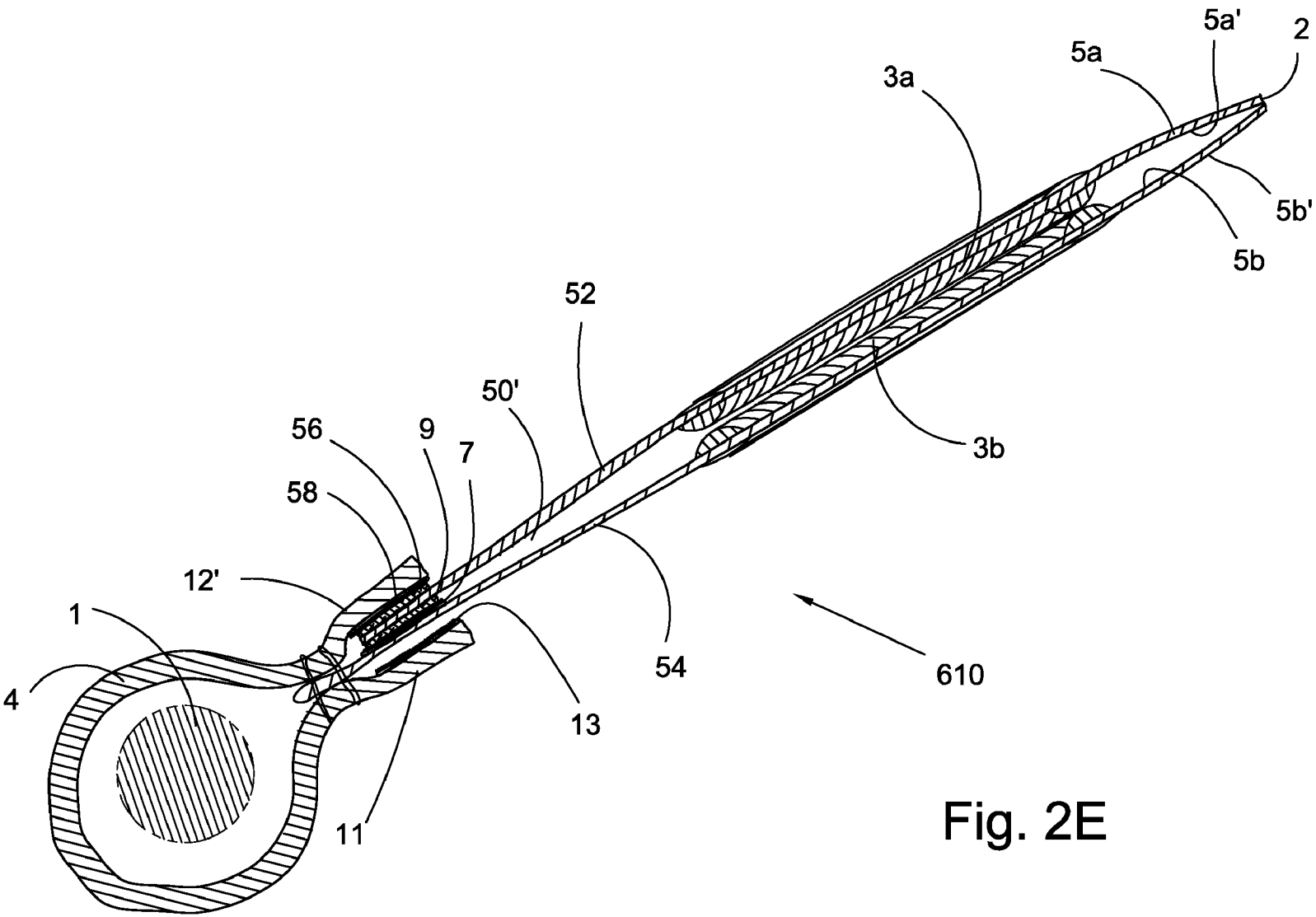
FIG. 2E is a view of the invention similar to FIG. 2D, except showing a modified embodiment having an extended flap and hook and loop fastener to prevent air from inflating the pouch when the flag is an in "inside-out" orientation.

As best shown FIG. 2A, outer fastener 4 includes a loop of material that encircles mast 1; the loop of material terminates in flaps 11 and 12 which are arranged to releasably secure and seal the flag. Flaps 11 and 12 are stitched to one another and to second panel 54. The fastener uses hook and loop fasteners to secure the flag. The hook and loop strips 7, 9 and 13 extend substantially along the entire width of the flag. Hook strip 7 is fixedly secured to surface 5*b* of second panel 54. Hook strip 13 is fixedly secured to the inner surface of flap 11. Loop strip 9 is fixedly secured to surface 5*a* of first panel 52. When arranged outside out, hook and loop fastener 13 and 9, respectively, engage one another and secure flap 11 to panel 52 to keep pouch 50 closed. FIG. 2C illustrates hook strip 10 being pulled away from loop strip 9 in anticipation of turning the flag inside-out. When the flag is turned inside-out, hook and loop fastener 7 and 9, respectively, engage one another as shown in FIG. 2D. As shown in the drawing, hook strip 13 is left disconnected when the flag is turned inside-out. However, another loop strip (not shown) could be arranged on outer surface 5*b*' of panel 54 to further secure the flag in the inside-out orientation. FIG. 2E shows a modified embodiment of the invention. This view, which is similar to the view of FIG. 2D, shows the flag in an inside-out orientation. In this modified embodiment, flap 12 has been replaced by a longer flap 12'; loop fastener strip 56 is secured to surface 5*a*' of panel 52, hook fastener strip 58 is attached to an inside surface of flap 12', and hook and loop fasteners 58 and 56, respectively, engage one another to hold flap 12' to panel 52, thereby preventing wind from entering pouch 50' and opening the flag. Although the various hook and loop fasteners have been designated by references numbers, it should be immediately apparent to one of ordinary skill in the art that the hook and loop fasteners could be switched or rearranged without departing from the sprit and scope of the invention as claimed. It should be appreciated that the orientation of flaps 11 and 12 exterior to panels 52 and 54 uniquely protects the flag from opening due to wind and air filling pouch 50 when the flag is mounted to a moving vehicle. The air passes over the flaps and is prevented from entering the pouch.

Figure 3:
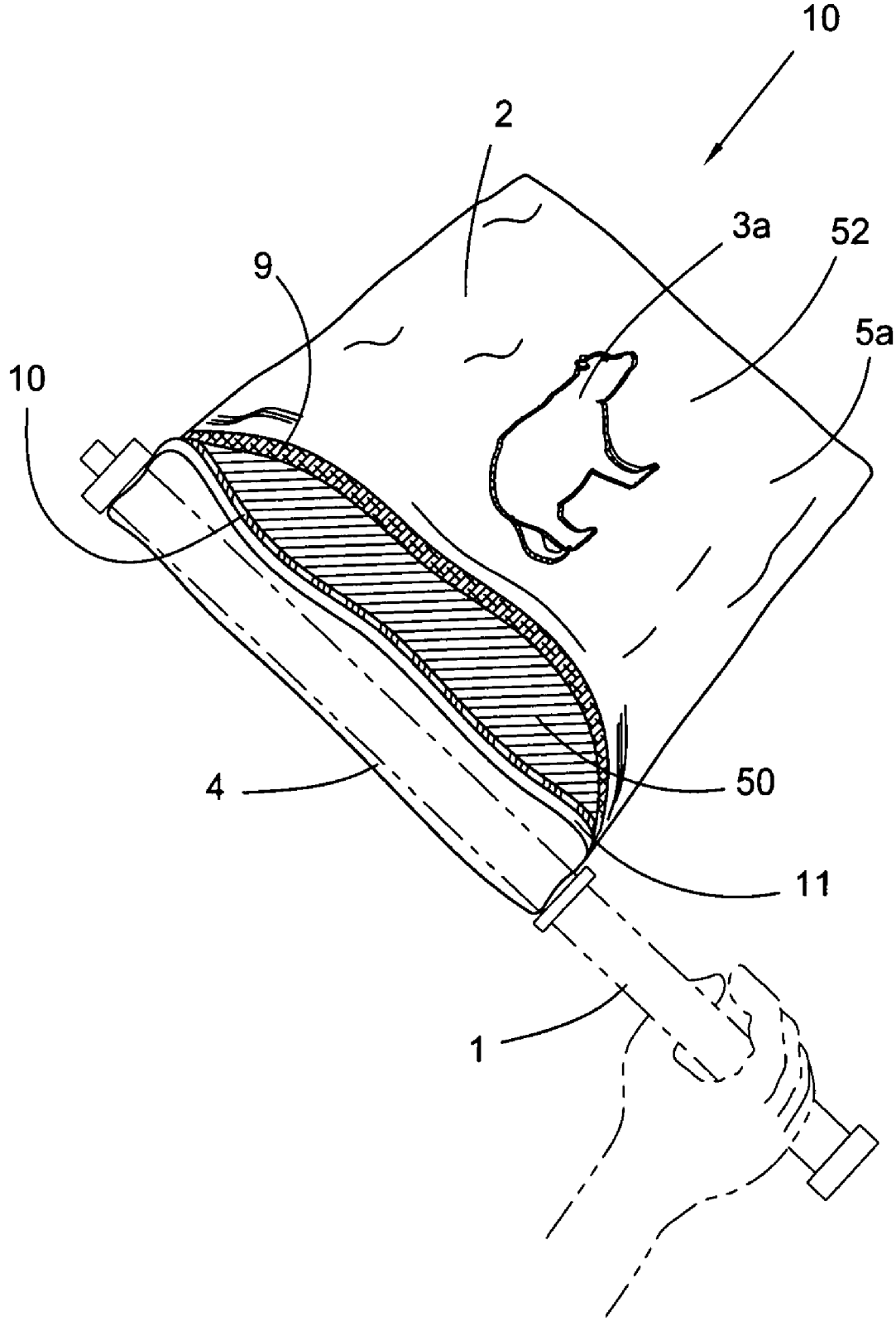
FIG. 3 is a perspective view of the flag shown in FIG. 1, but with the closure element of the flag in an open position to reveal the inner pouch of the flag in preparation for turning the flag inside-out.
Figure 4:
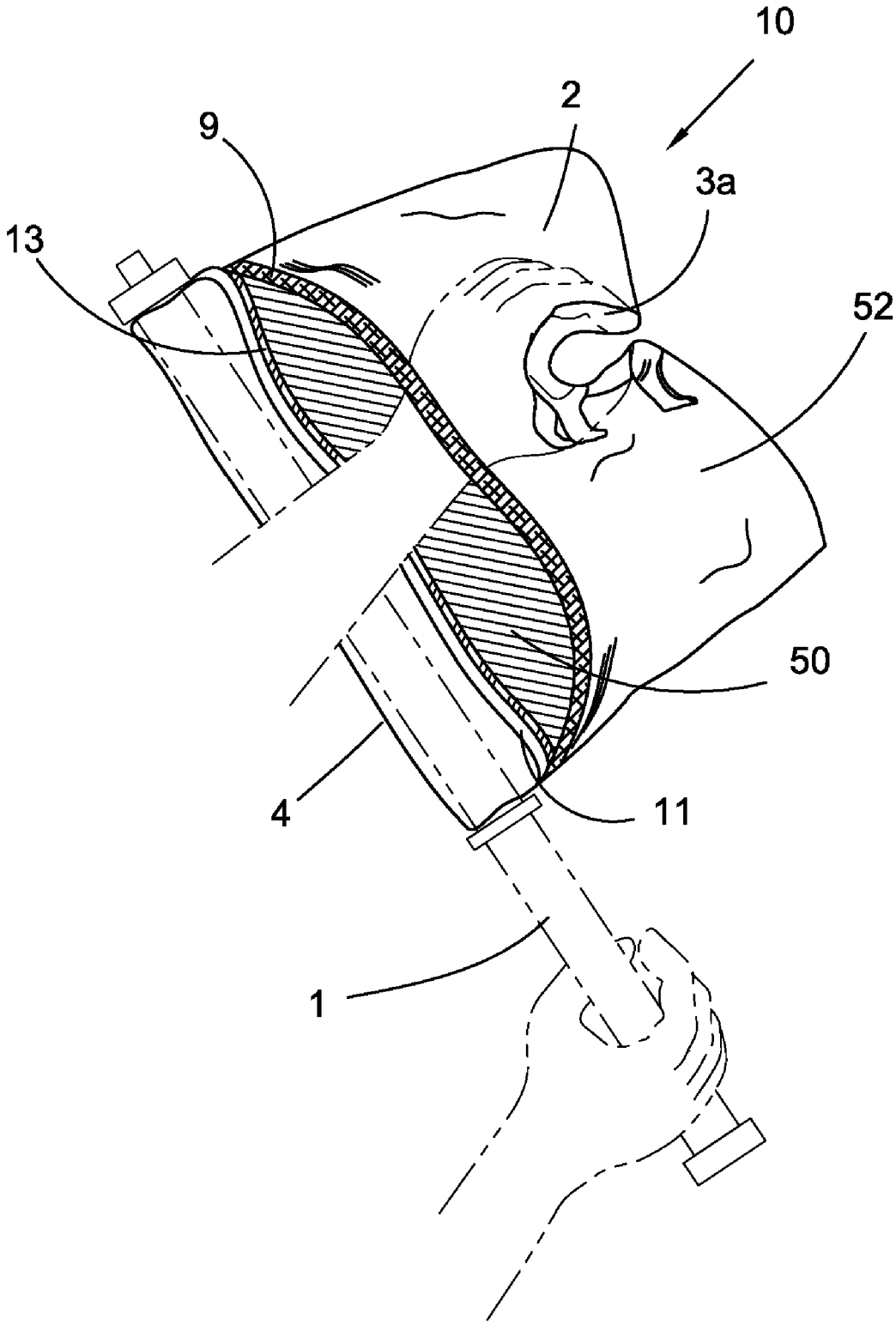
FIG. 4 is a perspective view similar to that of FIG. 3, illustrating a person reaching inside pouch 50 to turn the flag inside-out.
Figure 5:
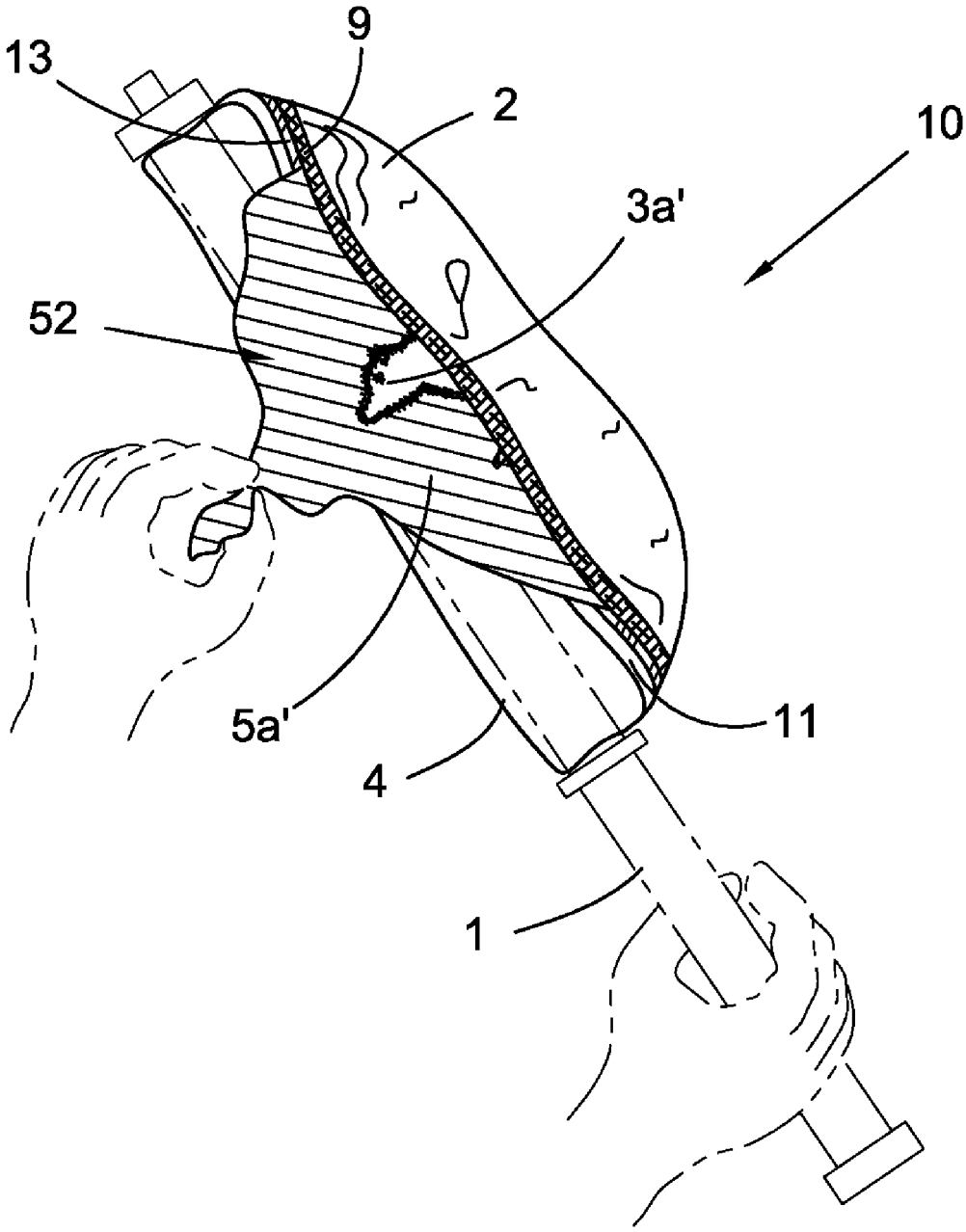
FIG. 5 is a perspective view similar to that of FIG. 4, showing continued pulling of the flag into an inside-out orientation to reveal indicia 3*b*' on inner surface 5*b;*
Figure 6A:
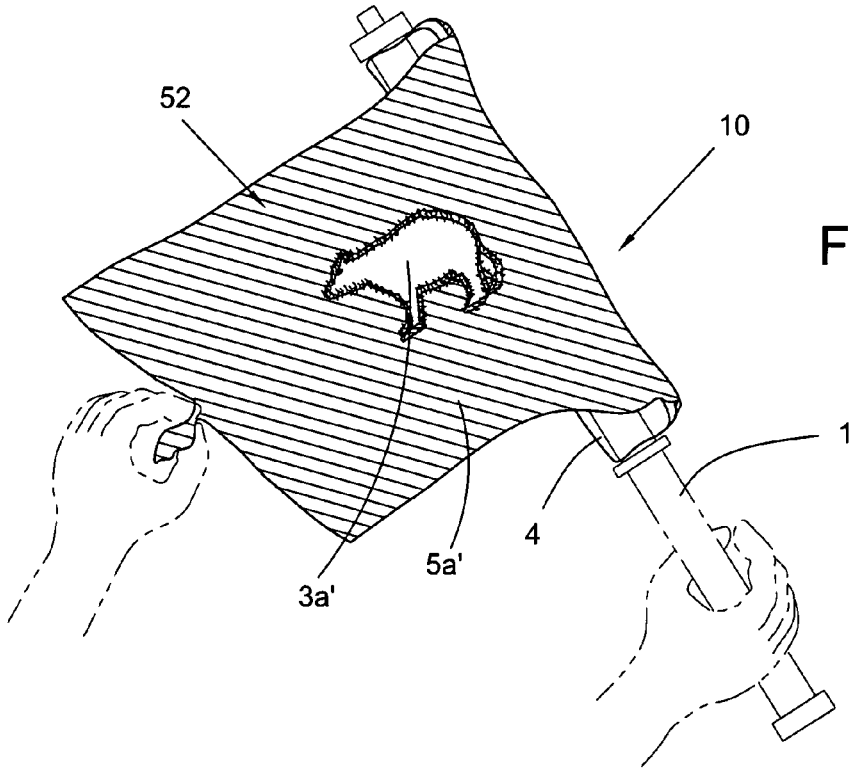
FIGS. 6A and 6B are perspective views similar to that of FIG. 5, showing the flag in an inside-out orientation.
Figure 6B:
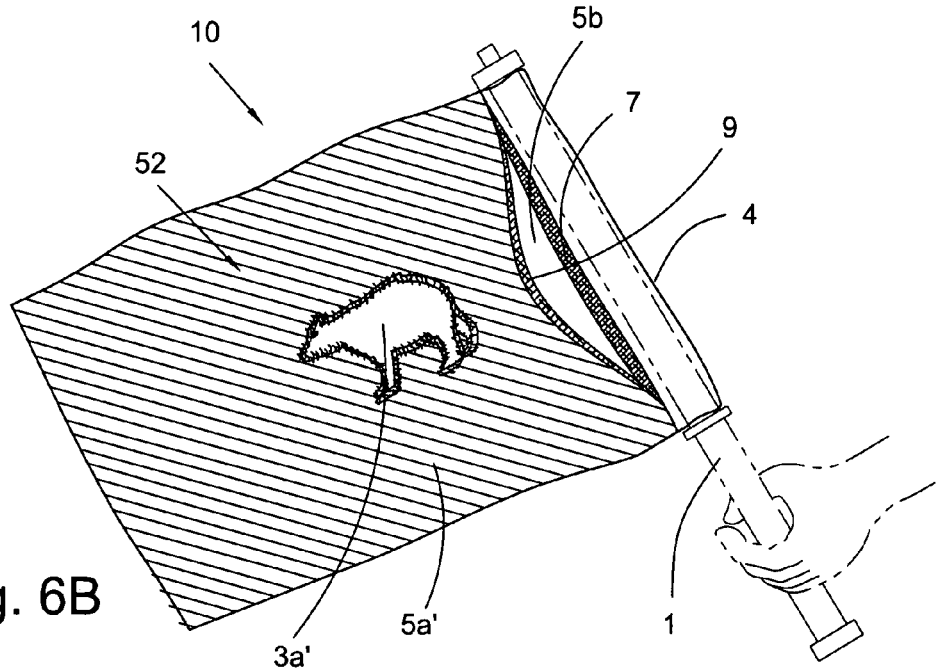

FIGS. 3-6B are perspective views of a preferred embodiment flag of the present invention, showing the flag being reversed, i.e., being turned inside-out. In FIG. 3, first panel 52 has been released from both outer fastener 4 and second panel 54. When first panel 52 is released from second panel 54, opening or pouch 50 is revealed between the panels. Pouch 50 allows the user to insert her hand inside of the flag to grasp the far end. Once the user grasps the far end, she pulls the far end through the opening as seen in FIG. 5. As described supra, since first panel 52 or second panel 54 is fixedly secured to outer fastener 4, sides 5*a*' and 5*b*' are visible when the flag is turned inside out. By visible, we mean that when the flag is turned inside-out, sides 5*a*' and 5*b*' each face outward and can be seen, while sides 5*a* and 5*b* are hidden inside the flag and directed towards one another. In FIGS. 6A and 6B, side 5*a*' of panel 52 is visible since the flag has been turned inside-out, revealing indicia 3*a'*.

Figure 7:
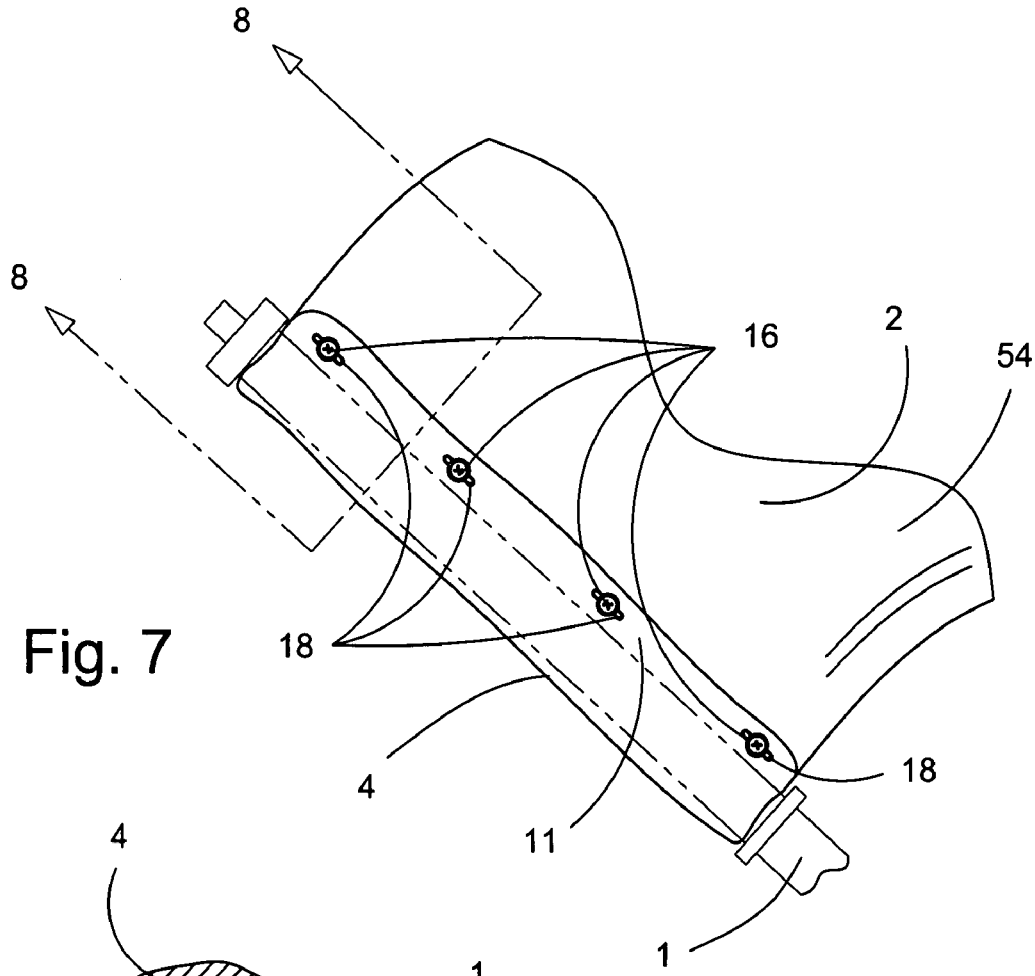
FIG. 7 is a perspective view of a second embodiment of the present invention using buttons as the fastening means to secure the flag to the mast.
Figure 8:
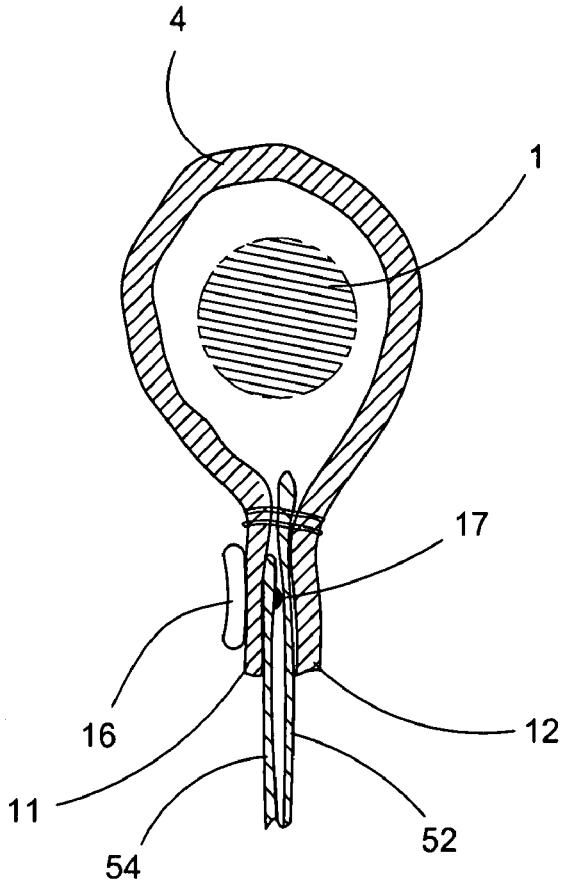
FIG. 8 is a fragmentary cross-sectional view taken generally along line 8-8 of FIG. 7.

FIG. 7 is a partial perspective view of another preferred embodiment of the present invention. FIG. 8 is a partial cross-sectional view taken generally along lines 8-8 in FIG. 7. In this embodiment, the flag includes buttons 16 which are secured by thread 17 similar to a traditional shirt button. In this arrangement, the first panel, the second panel, and the other flap have slots 18 which are arranged to receive button 16. In another embodiment, the buttons are traditional snap buttons or magnetic buttons. The snap buttons and magnetic buttons function similar to buttons 16, whereby the snap buttons and magnetic buttons travel through an opening in the first and second panels. Although the invention has been described using snap and magnetic buttons to secure the flag, any releasable connection means known in the art can be used and is within the spirit and scope of the invention as claimed.

Figure 9:
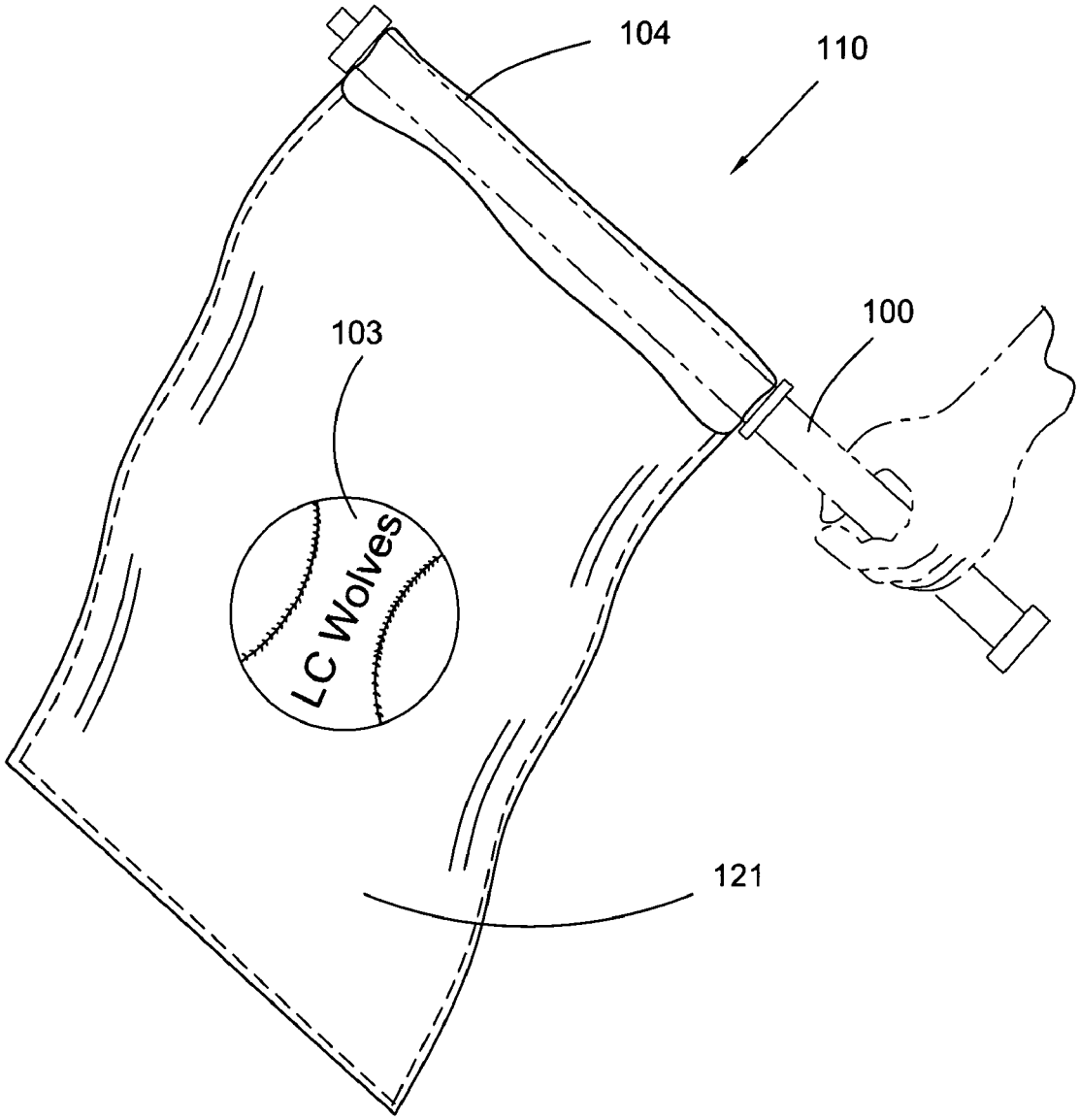
FIGS. 9 and 10 are perspective views of a second embodiment of the present invention, where a different sports team logo appears on the outside and inside surfaces of the flag.
Figure 10:
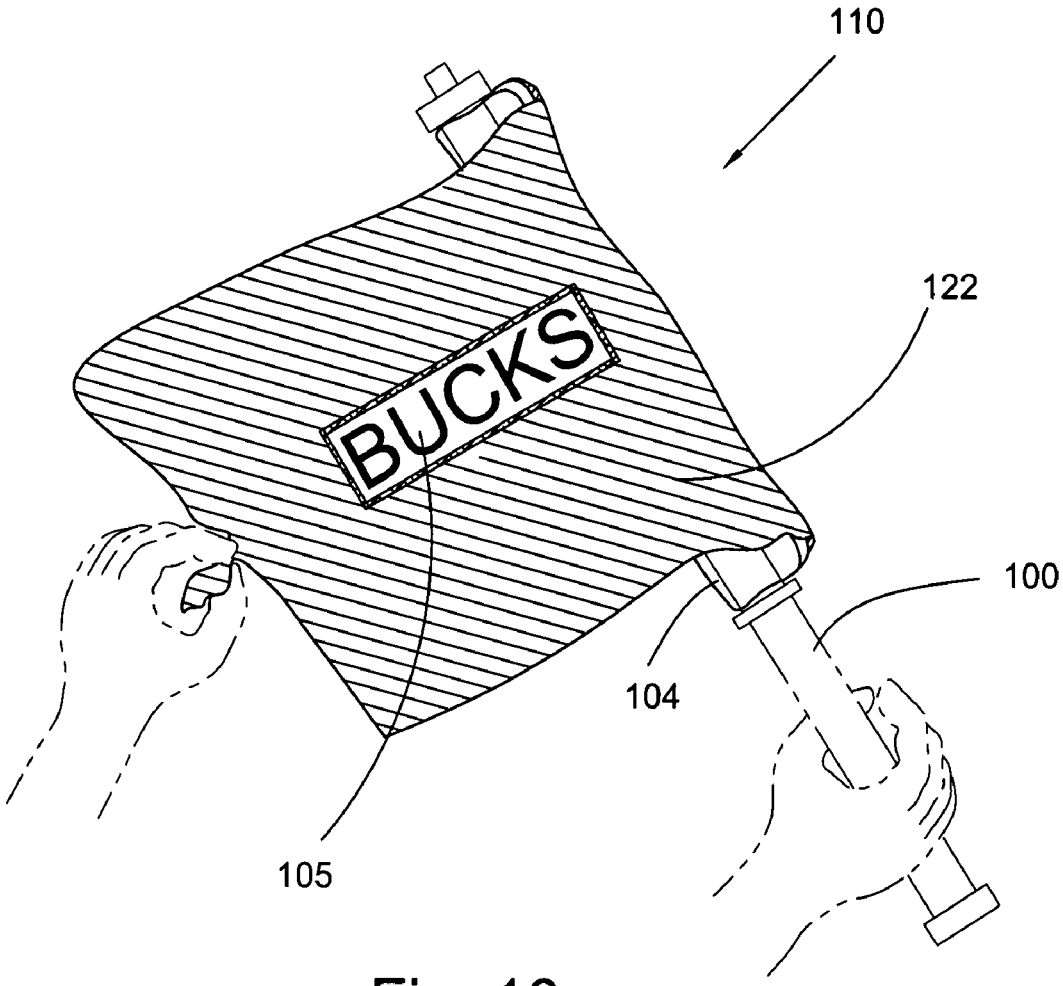

FIGS. 9 and 10 illustrate another embodiment of the invention flag assembly 110. The flag is releasably attached to mast 100 by outer fastener 104. In this embodiment, a first indicia 103 appears on the outside surface 121 of the flag, as shown in FIG. 9, and a second indicia 105 appears on the inside surface 122 of the same panel when the flag is turned inside out. For example, the logo for the "LC Wolves" appears when the flag is oriented outside-out, and the logo for the "Bucks" appears when the flag is turned inside-out.

Figure 11:
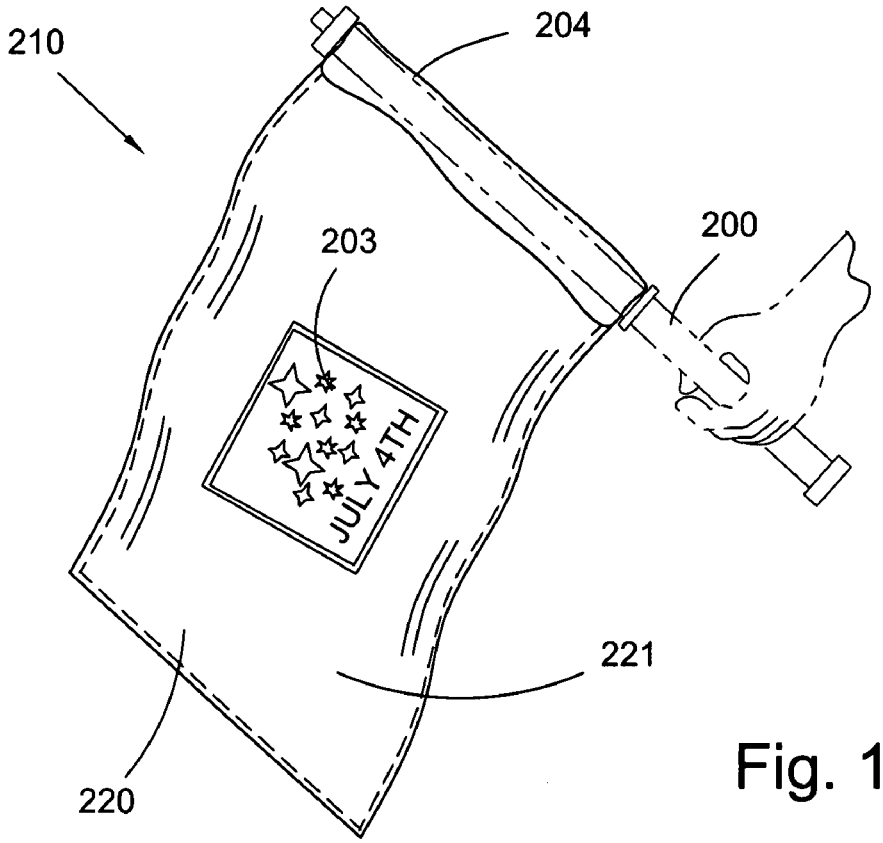
FIGS. 11 and 12 are perspective views of a third embodiment of the present invention, where a graphic design associated with a holiday (e.g., Fourth of July) is displayed on an outside surface of the flag, and a graphic design associated with a different holiday (e.g., Thanksgiving) is displayed on an inside surface of the same flag; and, FIGS. 13, 14 and 15 illustrate alternative shapes of the flag of the present invention.
Figure 12:
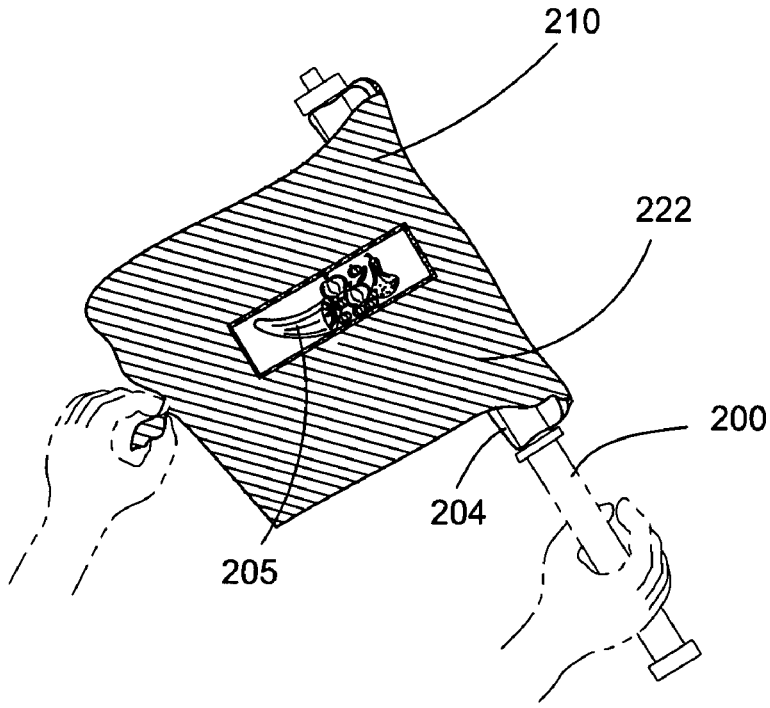

FIGS. 11 and 12 illustrate yet another embodiment of the invention. Flag assembly 210 of this embodiment is shown to include flag 220, fastener 204, outside surface 221, and mast 200. In this embodiment, outer indicia 203 relates to a first holiday (e.g., the $4^{th}$ of July), while the obverse indicia 205 on inner surface 222, which is visible when the flag is turned inside-out, relates to a second holiday (e.g., Thanksgiving).

Figure 13:
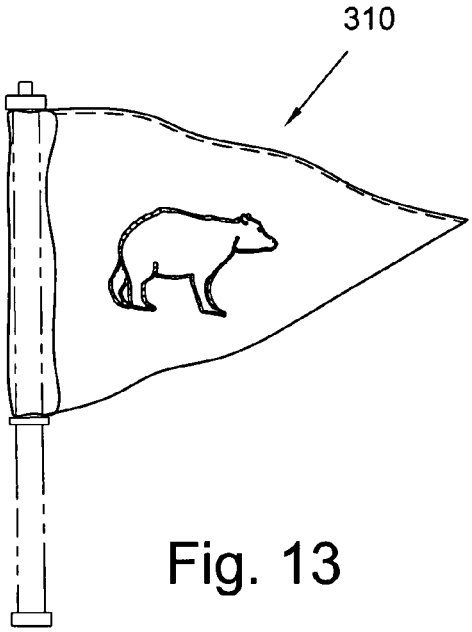
Figure 14:
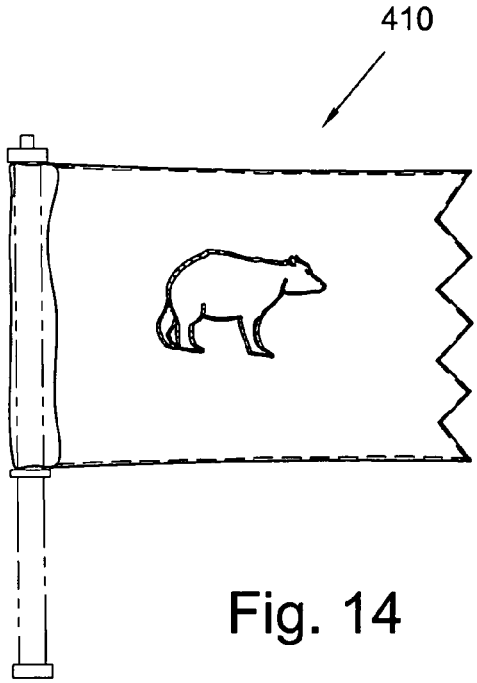
Figure 15:
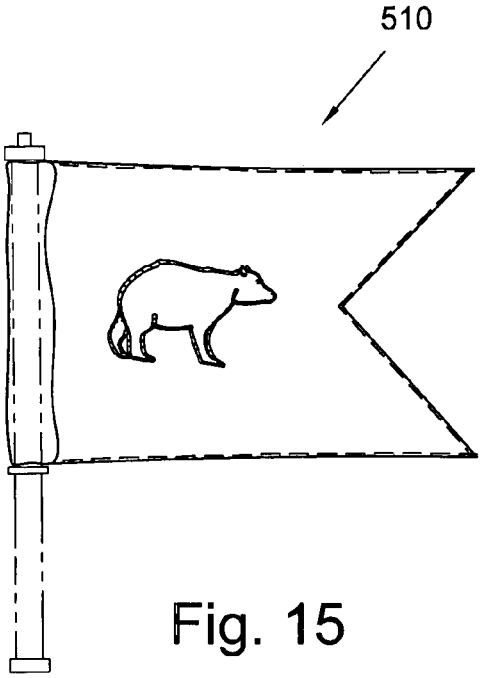

Although the flag shown in FIGS. 1-12 is generally rectangular in shape, it should be appreciated that the flag could take any shape, including but not limited to square, triangular, octagonal, circular, or an irregular shape. Examples of various shaped flags in flag assemblies 310, 410, and 510 are intended to be within the scope of the present invention as claimed are shown in FIGS. 13-15, although other shapes are contemplated and considered to also be within the scope of the claims.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A reversible flag assembly comprising:

a flag, said flag including:

a first panel having an outer surface and an inner surface, said first panel bearing a first outer indicia visible from said outer surface when said flag is turned outside-out, and a first inner indicia visible from said inner surface when said flag is turned inside-out;

a second panel having an outer surface and an inner surface, said second panel bearing a second outer indicia visible from said outer surface when said flag is turned outside-out, and a second inner indicia visible from said inner surface when said flag is turned inside-out;

said first and second panels each having a perimeter, said perimeters of said first and second panels substantially secured to one another to form a pouch having a single opening to accommodate turning said flag inside-out a mast; and, a fastener operatively arranged to secure said flag to said mast;

wherein said fastener comprises a loop of material operatively arrange to encircle said mast, said loop of material having a first end flap and a second end flap, said first end flap fixedly secured to said second end flap and said second panel, said second end flap having a strip of hook fastening material fixedly secured to an inner surface thereof, said fastener further comprising a strip of loop fastening material fixedly secured to the outer surface of said first panel and operatively arranged to engage said strip of hook fastening material of said second end flap to hold said pouch closed when said flag is in the outside-out orientation, said fastener further comprising a second strip of hook fastening material fixedly secured to the outer surface of said second panel, wherein said second strip of hook material is operatively arranged to engage said strip of loop material of said first panel to hold said pouch closed when said flag is in the inside-out orientation.

2. The flag recited in claim 1 wherein said fastener further comprises a strip of loop fastening material fixedly secured to the outer surface of said first panel and operatively arranged to engage a strip of hook fastening material secured to an inner surface of said first end flap to hold said pouch closed when said flag is in the inside-out orientation.

* * * * *